United States Patent [19]

Martin

[11] Patent Number: 5,012,734

[45] Date of Patent: May 7, 1991

[54] DEVICE FOR PRINTING ENDORSEMENTS OF DOCUMENTS

[75] Inventor: Emilio B. Martin, Madrid, Spain

[73] Assignee: Amper, S.A., Madrid, Spain

[21] Appl. No.: 347,499

[22] Filed: May 4, 1989

[30] Foreign Application Priority Data

May 4, 1988 [ES] Spain ..... 8801366

[51] Int. Cl.[5] ..... B41L 47/46

[52] U.S. Cl. ..... 101/91; 101/76

[58] Field of Search ..... 101/76, 77, 91, 232, 101/233, 234, 235

[56] References Cited

U.S. PATENT DOCUMENTS

| | | | |
|---|---|---|---|
| 2,743,671 | 5/1956 | Weber et al. | 101/235 |
| 2,802,416 | 8/1957 | Karkow | 101/235 |
| 3,037,447 | 6/1962 | Gonzalez | 101/91 |
| 4,178,847 | 12/1979 | Erhardt | 101/91 |
| 4,278,023 | 7/1981 | Call et al. | 101/235 |
| 4,596,185 | 6/1986 | Enter | 101/235 |

FOREIGN PATENT DOCUMENTS

| | | |
|---|---|---|
| 0051958 | 5/1982 | European Pat. Off. . |
| 746719 | 3/1956 | United Kingdom . |

*Primary Examiner*—Edgar S. Burr

*Assistant Examiner*—Joseph R. Keating

*Attorney, Agent, or Firm*—Johnson & Gibbs

[57] ABSTRACT

Device for printing endorsements on documents passing through a document processing apparatus. The device comprises a rotatable outer housing having a cylindrically shaped exterior surface and a ring gear having a toothed first part and a toothless second part. A stamp for printing endorsements and at least one band having digits or characters thereon form a substantially continuous surface with the exterior surface of the outer housing. When the endorsing device is rotated by a pinion meshing with the ring gear, the digits or characters, as well as the stamp, contact a document passing through the document processing apparatus. During the rotation of the outer housing, further rotation is prevented by an arm which engages a projection on the outer housing and biasing means which biases the arm into locked engagement with the projection. When the arm engages the projection, the pinion is unable to rotate the outer housing as the toothless part of the ring gear is now facing the pinion. To release the outer housing, the force biasing the arm into locked engagement is removed. A second biasing means rotationally biases the outer housing so that the pinion will be able to mesh with the toothed portion of the ring gear, thereby continuing the rotation of the endorsing device.

20 Claims, 2 Drawing Sheets

DEVICE FOR PRINTING ENDORSEMENTS OF DOCUMENTS

FIELD OF THE INVENTION

This invention is related to a device for printing endorsements on documents. More specifically, this invention is related to a device for printing endorsements on documents passing through a document processing device such as a document reader and/or printer.

BACKGROUND OF THE INVENTION

Many different devices for processing documents are known. Most commonly, such devices are capable of reading magnetic or other types of characters imprinted on a document and/or printing magnetic or other types of characters onto the document. While the various configurations of document processing devices which include reading and/or printing means are diverse, such devices generally include a guide through which the document passes during processing. The document is drawn through the guide by pull rollers, passing through read and/or print stations for reading characters from and/or printing characters onto the document.

Endorsing devices, on the other hand, print a specific distinguishing mark on the back or reverse side of the document being endorsed. Document processing stations which read characters from or print characters onto a document may include an endorsing device as well. Such endorsing devices may either be an impact type endorsing device or a roller type endorsing device. An impact type endorsing device includes an impact member which strikes the document passing through the endorsing device, thereby producing an impact on the document which results in the printing of the character or characters provided on the impact member onto the document. A roller type endorsing device rotates a roller into contact with the document as the document passes through the endorsing station, thereby leaving an imprint of the character or characters on the roller on the document.

Among the disadvantages of using an impact type endorsement device in a document processing system is that in order to print the endorsement on a document, the advancement of the document must be stopped, the endorsing device activated to print the endorsement on the document and the advancement of the document resumed. Such a procedure results in the loss of time. As a result, the processing of documents is slower.

Another disadvantage of using an impact type endorsement device in a document processing system is that impact devices must be repeatedly inked. It is difficult to conceive of an inking system for an impact type endorsement device which will satisfactorily operate within the size and price constraints imposed upon document processing systems.

While roller type endorsers do not require the stopping of the document typically required by impact type endorsers, a disadvantage often present in roller type endorsing devices is that the rotation of the roller which contacts the document continues the entire time that documents are passing through the roller type endorsing device. As a result, the roller will indiscriminately endorse all documents passing through the endorsing device unless the roller is stopped, usually by a manual operation.

Another disadvantage of the roller type endorsing systems is that, apart from the date, the information printed on the document is always the same; i.e. it cannot be changed without performing the slow task of removing one stamp and installing another.

Printing devices are well known that have the feature that the printing is accomplished by the rotation of an endorser and not by impact type process. Such devices include a generally cylindrical housing and a series of wheels arranged inside the housing. Bands provided with digits or characters are positioned between a peripheral area of the cylindrical housing and the wheels. By activating the wheels, the digits or characters on the bands may be changed. The device is capable, therefore, of printing dates and inscriptions of any type which can be configured by the digits or characters provided on the bands.

The endorsing device proposed by the invention has been designed to completely solve these problems, offering for that purpose a structure that is extremely simple and which pertains to document processing apparatus such as reading and/or printing devices which process documents such as those issued by banking entities.

SUMMARY OF THE INVENTION

A device for printing endorsements on documents passing through a document processing devices such as a document reader and/or printer comprises a rotatable outer housing having an interior opening and a cylindrically shaped exterior surface. The exterior surface includes a notch which communicates with the interior opening. Mounted in the interior of the outer housing are at least one band having digits or characters thereon and a series of wheels. The bands project through the notch to form a substantially continuous surface with the exterior surface of the outer housing. Rotating the wheels will change the digits or characters on the part of the bands which form the substantially continuous surface with the exterior surface of the outer housing. A removable stamp for printing endorsements is also mounted on the exterior surface of the outer housing.

When the endorsing device rotates, the digits or characters positioned on the portion of the band forming the substantially continuous surface with the exterior surface of the outer housing and the stamp sequentially contact an inking roller and, once inked, contact a document passing through a document processing apparatus which includes a guide through which documents pass during processing, the endorsing device, which may be mounted at the entry or exit area of the guide, a backing plate for the endorsing device, a drive system, and a pinion to be rotated by the drive system.

The endorsing device is rotated by the pinion meshing with a ring gear attached to the outer housing. The ring gear has, however, a first part having teeth and a toothless second part. As a result, the pinion can mesh only with the toothed part of the ring gear. After the endorsing device has been rotated 360 degrees, the endorsing device is blocked from further rotation by an arm which engages a projection on the outer housing and biasing means such as a spring which biases the arm into locked engagement with the projection. When the arm engages the projection, the pinion is unable to rotate the outer housing as the toothless part of the ring gear is now facing the pinion.

To release the outer housing, the force biasing the arm into locked engagement with the projection is removed. A second biasing means rotationally biases the outer housing so that the pinion will be able to mesh with the toothed portion of the ring gear, thereby continuing the rotation of the endorsing device so that printing of the endorsement on the document passing through the guide may be accomplished.

BRIEF DESCRIPTION OF THE DRAWINGS

This invention may be better understood and its numerous objects and advantages will become apparent to those skilled in the art by reference to the following drawings in which.

DETAILED DESCRIPTION OF THE INVENTION

Figure 1:
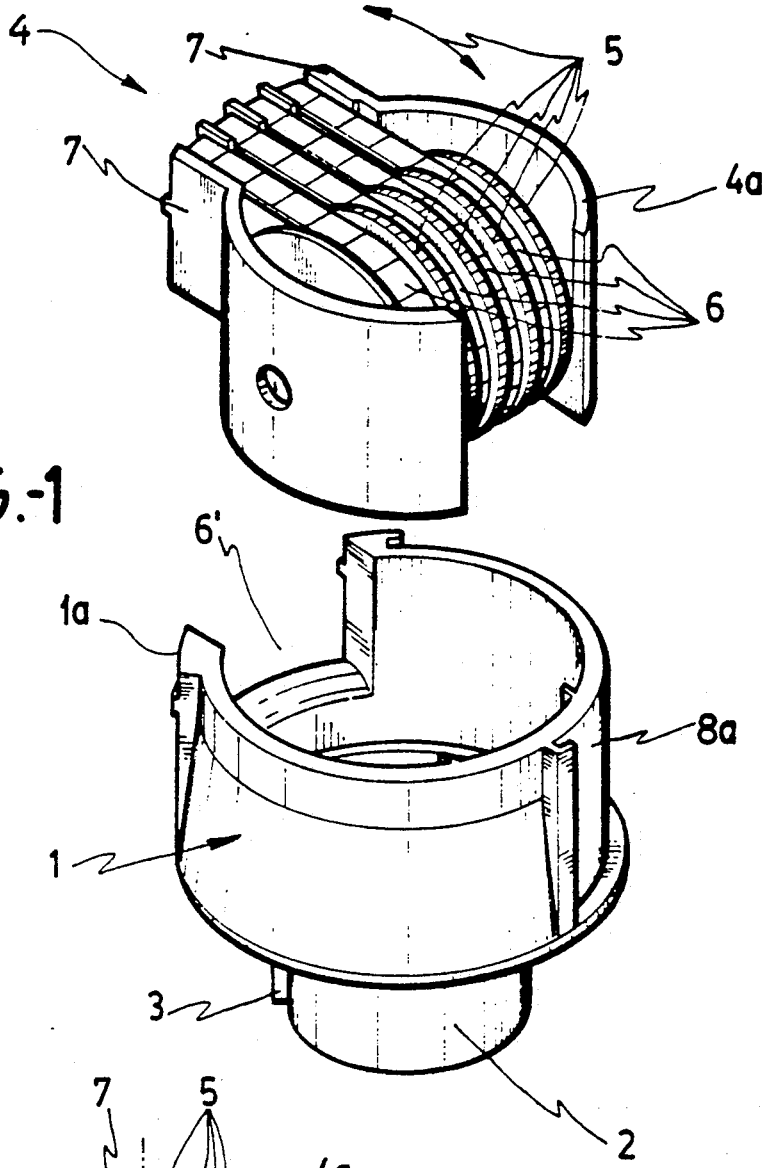
FIG. 1 is a perspective view of a device for printing endorsements constructed in accordance with the teachings of the present invention.

Turning first to FIG. 1, the device for endorsing documents of the present invention will now be described in greater detail. The device for endorsing documents is comprised of an outer housing 1 having an interior opening and a cylindrically shaped exterior surface 1*a*. Outer housing 1 is provided with notch 6' in communication with the interior opening. Outer housing 1 also includes a concentric neck 2 which extends downwardly from the lower portion of outer housing 1. Neck 2, which has a cylindrically shaped exterior surface and a diameter less than the diameter of housing 1, is provided with an oblique projection 3 in the direction of one of its generatrices.

Mounted in the interior of outer housing 1 is inner housing 4. Inner housing 4 is comprised of an interior opening, a generally cylindrical portion 4*a* concentric with the exterior surface 1*a* of outer housing 1 and flanges 7 integrally formed with cylindrical portion 4*a*. Flanges 7 extend into and are supported by notch 6', thereby retaining inner housing 4 within outer housing 1. Mounted in the interior of housing 4 are bands 6 having a plurality of digits and/or characters (not shown) thereon. Each band 6 projects into notch 6' such that a portion of each band 6, which would typically have a single digit or character thereon, forms a substantially continuous surface with exterior surface 1*a* corresponding to the location of notch 6'. Bands 6 may be moved such that a different portion of the bands form a substantially continuous surface with exterior surface 1*a* by rotatable wheels 5, also mounted in the interior of housing 4. The rotation of wheels 5 will cause bands 6 to move between the respective collars (not shown) fixed to the wheels 5 and the periphery of housing 4*a* which corresponds to the substantially continuous surface with the exterior surface 1*a* of outer housing 1.

In such a manner, inner housing 4 is positioned within outer housing 1 to form the device for printing endorsements. By rotating wheels 5, bands 6 may be continuously rotated to position any digit or character provided on the bands such that the digits or characters will be positioned on the portion of the bands which form the substantially continuous surface with the exterior surface 1*a*.

Figure 2:
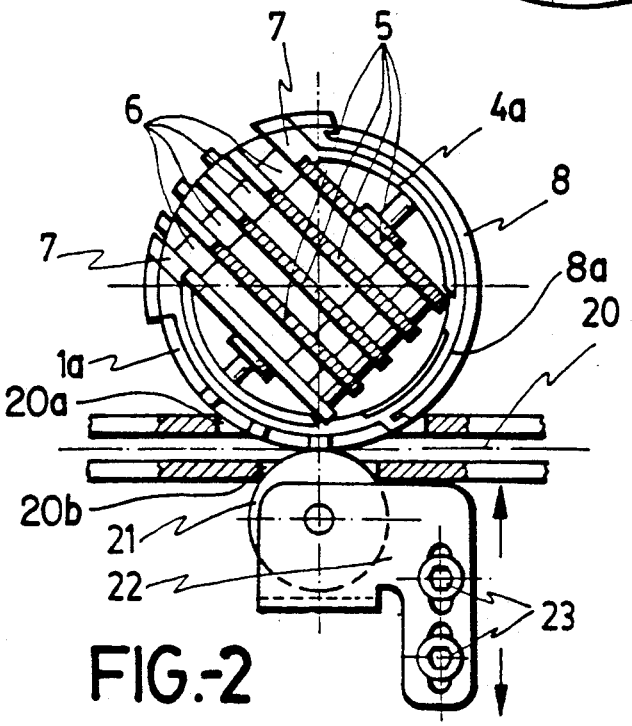
FIG. 2 is a top view of the device for printing endorsements illustrated in FIG. 1 and its relationship with a guide through which documents pass.
Figure 3:
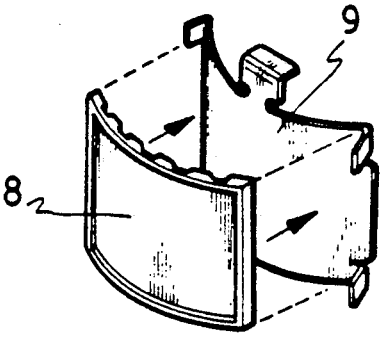
FIG. 3 is an exploded view of an endorsing stamp for mounting on the device for printing endorsements illustrated in FIGS. 1 and 2.

Turning next to FIGS. 2 and 3, the endorsing stamp carried by cylindrical housing 1 will now be described in greater detail. While only one embodiment of the configuration of the stamp is to be described herein, it is contemplated that numerous alternate embodiments of the stamp configuration will be satisfactory for the uses herein proposed. An indent 8*a* is provided on the exterior surface 1*a* of outer housing 1. A piece of rubber 8 or a similar material, which preferably bears a stamp or other identifying or characterizing mark (not shown) to be printed on documents during their endorsement, is attached to plate support 9. Plate support 9, in turn, is embedded in indent 8*a* of exterior surface 1*a* such that stamp 8, like the characters or digits of belt 6, form a substantially continuous surface with exterior surface 1*a*. To change the stamp or other identifying or characterizing mark to be printed on the document, a pull in the axial direction is exerted on stamp 8 to remove stamp 8 and plate support 9 from indent 8*a*. An axial pressure is then exerted on a second plate support 9 carrying a second stamp 8 to install the new stamp in indent 8*a*.

Figure 4:
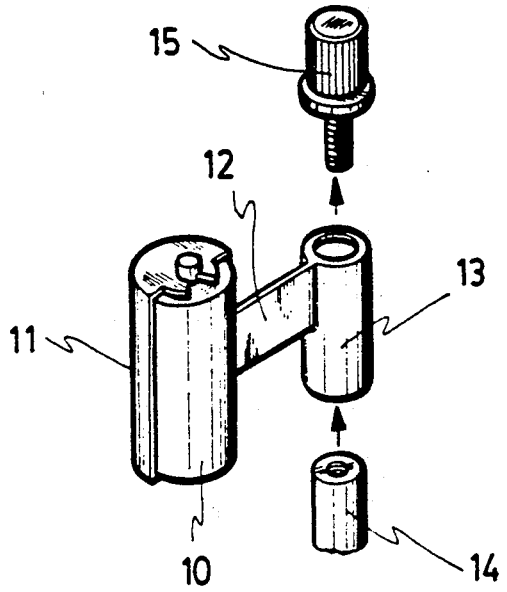
FIG. 4 is a partially exploded view of an inking roller for inking the device for printing endorsements illustrated in FIGS. 1-3.
Figure 5:
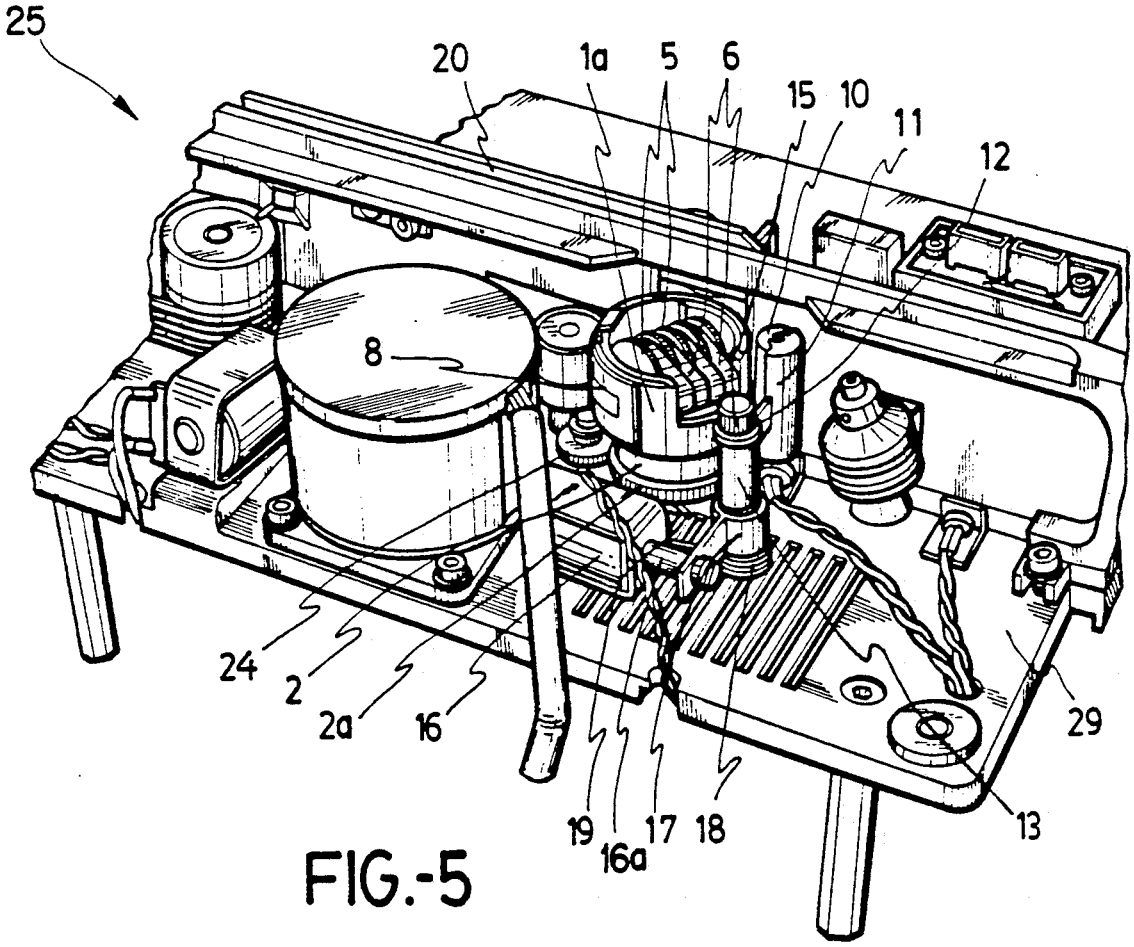
FIG. 5 is a perspective view of the device for printing endorsements illustrated in FIGS. 1-3 and the inking roller illustrated in FIG. 4 mounted in a reading/printer apparatus.

Turning now to FIGS. 4 and 5, inking roller 10, which is also mounted on reading/printing station 25 of FIG. 5, will now be more fully described. Inking roller 10, which is to be mounted near to and parallel with housing assembly 1, is rotatably connected to semi-housing 11. A support arm 12 extends from semi-housing 11 and terminates in a cylindrical portion 13. Cylindrical portion 13 is rotatably mounted on column 14 of reading/printing station 25. Screw 15 holds cylindrical portion 13 in place on reading/printing station 25. If desired, inking roller 10 and semi-housing 11 may be removed from reading/printing station 25 by removing screw 15 and lifting inking roller 10 and semi-housing 11 from column 14 of reading/printing station 25.

Focussing now on FIG. 5, the relationship of the device for endorsing documents illustrated in FIGS. 1-3 and a document processing apparatus such as reading/printing apparatus 25 upon which the device for endorsing documents of FIGS. 1-3 is installed is now more fully described. Reading/printing apparatus 25 includes a conventional drive means (not shown) such as a motor and drive shaft. Pinion 24 is mounted on the drive shaft and is rotated by the rotation of the drive shaft. Neck 2 of outer housing 1 includes a toothed ring gear 2*a*. Toothed ring gear 2*a*, which is to be more fully described later, is rotatably mounted on a shaft (not shown) such that toothed ring gear 2*a* may or may not mesh with pinion 24. Consequently, when the motor rotates the drive shaft, outer housing 1 may or may not rotate. When outer housing 1 is rotated by pinion 24, stamp 8 mounted on the exterior surface 1*a* of housing 1 and housing 4, as well as wheels 5 and bands 6 mounted in the interior of housing 4, are also rotated.

The endorsement of documents by the endorsing device will now be described in detail. Inking roller 10 is mounted on column 14 of reading/printing apparatus 2. Arm or pawl 17 is rotatably mounted on column 14 such that the end of arm or pawl 17 may face projection 3 of cylindrical neck 2. Electromagnet 16, which is mounted on reading/printing apparatus 25, includes a core 16*a* which acts on arm or pawl 17. When electromagnet 16 is in a first or rest state, spring 18 exerts a biasing force on arm or pawl 17 such that arm or pawl 17 is in locked engagement with projection 3. As a result of the locked engagement of arm or pawl 17 and projection 3, outer housing 1 is prevented from rotating. Furthermore, when arm or pawl 17 is in locked engagement with projection 3, pinion 24 faces the toothless portion of ring gear 2*a*, thereby preventing pinion 24 from meshing with ring gear 2*a* to rotate outer housing 1.

When electromagnet 16 is activated as a result of receiving a command, electromagnet 16 enters a second or active state. In this state, electromagnet 16 will act on arm or pawl 17 to release arm or pawl 17 from the locked engagement with projection 3, thereby permitting outer housing 1 to rotate. In order to release arm or pawl 17 from projection 3, spring 19 disposed beneath outer housing 1 will exert a small rotational biasing force on outer housing 1 at the moment the electromagnet is activated, thereby initiating rotational movement by outer housing 1 which will produce the release of arm or pawl 17 with respect to projection 3. The rotational movement of outer housing 1 produced by the rotational biasing force of spring 19 will rotate ring gear 2*a* sufficiently so that pinion 24 will mesh with the toothed portion of ring gear 2*a*, thereby rotating outer housing 1. As the drive means is now connected to ring gear 2*a*, outer housing 1 will begin a single rotation.

Referring now to FIGS. 2 and 5, the outer housing 1 of the endorsing device is mounted near guide 20 through which documents to be endorsed pass such that outer housing 1 projects through opening 20*a* in guide 20. On the opposite side of guide 20, die roller 21, which acts as a backing plate for outer housing 1, is mounted on reading/printing apparatus 25 by spring 22 such that die roller 21 projects through opening 20*b* in guide 20. Adjustment screws 23 are provided in order to increase or decrease the pressure of die roller 21 against outer housing 1. When a document passes through guide 20 and between outer housing 1 and die roller 21, then the rotation of outer housing 1 commenced by the activation of electromagnet 16 and the release of the locking engagement of arm or pawl 17 and projection 3 and continued by the meshing of pinion 24 with the toothed portion of ring gear 2*a*, will cause stamp 8 and the digits or characters provided on bands 6 which form the substantially continuous surface with outer housing 1, to project through opening 20*a* in guide 20 and press against the document and die roller 21, thereby stamping the desired endorsement on the back of the document.

When outer housing 1 has completed a full rotation, i.e. rotated 360 degrees, outer housing 1 is again stopped by the locking of arm or pawl 17 on projection 3 and the disengagement of pinion 24 from ring gear 2*a* due to the toothless portion. Outer housing 1 will not continue to rotate until electromagnet 16 receives another command and is again activated.

It is not considered necessary to make this description more extensive for any expert on the subject to be able to understand the scope of the invention and the advantages deriving therefrom. The materials, shape, size and arrangement of the components may be varied, as long as this does not involve an alternation of the essence of the invention. Finally, the terms used in the description of this report must always be taken in the broader and not a limited sense.

Thus, there has been described and illustrated herein, a device for printing endorsements on documents passing through a document processing device such as a document reader and/or printer. However, those skilled in the art will recognize that many modifications and variations besides those specifically mentioned may be made in the techniques described herein without departing substantially from the concept of the present invention. Accordingly, it should be clearly understood that the form of the invention described herein is exemplary only, and is not intended as a limitation on the scope of the present invention.

What is claimed is:

1. Apparatus for printing endorsements on documents comprising:

a rotatable outer housing, said outer housing having an interior opening, a projection and a cylindrically shaped exterior surface, said exterior surface of said outer housing having a notch in communication with said interior opening;

an arm;

means for biasing said arm into engagement with said projection, thereby stopping the rotation of said outer housing, and for biasing said arm out of engagement with said projection, thereby permitting the continued rotation of said outer housing;

a stamp for printing an endorsement on said documents, said stamp mounted on said exterior surface of said outer housing;

an inner housing mounted in said interior opening of said outer housing;

at least one band having characters or digits thereon, said at least one band supported by said inner housing and projecting through said notch to form a substantially continuous surface with said exterior surface of said outer housing;

a circular ring gear attached to said outer housing, said ring gear having teeth along a first part of its circumference, said ring gear being toothless along a second part of its circumference;

a rotatable pinion for engaging the teeth along said first part of said ring gear to rotate said outer housing, said pinion unable to engage said second part of said ring gear; and spring means for rotationally biasing said outer housing so that said pinion may engage said toothed portion of said ring gear.

2. The apparatus for printing endorsements according to claim 1 further comprising:

an inking roller, said inking roller positioned tangentially to said outer housing, said characters or digits disposed on said at least one band forming said substantially continuous surface with said outer housing and said stamp mounted on said exterior surface of said outer housing contacting said inking roller when said outer housing rotates.

3. The apparatus for printing endorsements according to claim 1 further comprising a column, said arm and said inking roller rotatably mounted on said column.

4. The apparatus for printing endorsements according to claim 3 further comprising a removable semi-housing, said inking roller mounted on said semi-housing.

5. The apparatus for printing endorsements according to claim 4 further comprising wheels removably mounted in said interior housing, wherein the rotation of said wheels rotates said bands, thereby changing said characters or numbers forming a substantially continuous surface with said outer housing.

6. The apparatus for printing endorsements according to claim 1 wherein said stamp forms a substantially continuous surface with said exterior surface of said outer housing.

7. Apparatus for processing documents comprising:

a base;

a rotatable outer housing mounted on said base, said outer housing having an interior opening, a projection and a cylindrically shaped exterior surface, said exterior surface of said outer housing having a notch in communication with said interior opening;

an arm;

means for biasing said arm into engagement with said projection, thereby stopping the rotation of said outer housing, and for biasing said arm out of engagement with said projection, thereby permitting the continued rotation of said outer housing;

a stamp for printing an endorsement on said documents, said stamp mounted on said exterior surface of said outer housing;

a inner housing mounted in said interior opening of said outer housing;

at least one band having characters or digits thereon, said at least one band supported by said inner housing and projecting through said notch to form a substantially continuous surface with said exterior surface of said outer housing;

a guide mounted on said base, said documents being processed passing through said guide, said guide having an opening through which said substantially continuous surface of said outer housing projects therethrough during rotation;

a die roller mounted on said base, said substantially continuous surface of said outer housing projecting through said guide, said substantially continuous surface of said outer housing projecting through said guide tangentially contacting said die roller;

a circular ring gear attached to said outer housing, said ring gear having teeth along a first part of its circumference, said ring gear being toothless along a second part of its circumference;

a rotatable pinion mounted on said base for engaging the teeth along said first part of said ring gear to rotate said outer housing, said pinion unable to engage said second part of said ring gear; and spring means for rotationally biasing said outer housing so that said pinion may engage said toothed portion of said ring gear.

8. The apparatus for processing documents according to claim 7 further comprising an inking roller, said inking roller positioned tangentially to said outer housing, said characters or digits disposed on said at least one band forming said substantially continuous surface with said outer housing and said stamp mounted on said exterior surface of said outer housing contacting said inking roller when said outer housing rotates.

9. The apparatus for processing documents according to claim 8 wherein said base further comprises a column, both said inking roller and said arm rotatably mounted on said column.

10. The apparatus for printing endorsements according to claim 7 wherein said stamp forms a substantially continuous surface with said exterior surface of said outer housing.

11. Apparatus for printing endorsements on documents comprising:

a rotatable housing, said housing having a cylindrically shaped exterior surface and a projection;

an arm;

means for biasing said arm into engagement with said projection, thereby stopping the rotation of said outer housing, and for biasing said arm out of engagement with said projection, thereby permitting the continued rotation of said outer housing;

a stamp for printing an endorsement on said documents, said stamp mounted on said exterior surface of said housing;

at least one band having characters or digits thereon, said at least one band supported by said housing and forming a substantially continuous surface with said exterior surface of said housing;

a circular ring gear attached to said housing, said ring gear having teeth along a first part of its circumference, said ring gear being toothless along a second part of its circumference;

a rotatable pinion for engaging the teeth along said first part of said ring gear to rotate said outer housing, said pinion unable to engage said second part of said ring gear; and spring means for rotationally biasing said outer housing so that said pinion may engage said toothed portion of said ring gear.

12. The apparatus for printing endorsements according to claim 11 further comprising:

an inking roller, said inking roller positioned tangentially to said housing, said characters or digits disposed on said at least one band forming said substantially continuous surface with said housing and said stamp mounted on said exterior surface of said housing contacting said inking roller when said housing rotates.

13. The apparatus for printing endorsements according to claim 12 further comprising a column, said arm and said inking roller rotatably mounted on said column.

14. The apparatus for printing endorsements according to claim 13 further comprising a removable semi-housing, said inking roller mounted on said semi-housing.

15. Apparatus for printing endorsements on documents comprising:

a rotatable housing having a projection on its exterior surface;

an arm;

means for biasing said arm into engagement with said projection, thereby stopping the rotation of said outer housing, and for biasing said arm out of engagement with said projection, thereby permitting the continued rotation of said outer housing;

print means attached to said rotatable housing, said housing rotating said print means into contact with said documents, thereby printing endorsements on said documents;

a circular ring gear attached to said outer housing, said ring gear having teeth along a first part of its circumference, said ring gear being toothless along a second part of its circumference;

a rotatable pinion for engaging the teeth along said first part of said ring gear to rotate said outer housing, said pinion unable to engage said second part of said ring gear; and spring means for rotationally biasing said outer housing so that said pinion may engage said toothed portion of said ring gear.

16. The apparatus for printing endorsements according to claim 15 wherein said print means further comprises a stamp mounted on said exterior surface of said housing, said stamp printing endorsements on said documents.

17. The apparatus for printing endorsements according to claim 16 further comprising an inking roller positioned tangentially to said housing, said stamp contacting said inking roller when said outer housing rotates.

18. The apparatus for printing endorsements according to claim 15 wherein said housing further includes an interior opening and a notch in communication with said interior opening and wherein said print means further comprises at least one band having characters or digits thereon, said at least one band supported by said housing and projecting through said notch to form a substantially continuous surface with said exterior surface of said housing.

19. The apparatus for printing endorsements according to claim 18 and further comprising an inking roller positioned tangentially to said exterior surface of said housing, said characters or digits disposed on said at least one band contacting said inking roller when said housing rotates.

20. The apparatus for printing endorsements according to claim 19 further comprising a column, said arm and said inking roller rotatably mounted on said column.

* * * * *